United States Patent [19]

Vydrzal

[11] 4,051,980

[45] Oct. 4, 1977

[54] GRANULAR MATERIAL DISTRIBUTOR

[76] Inventor: Leroy Vydrzal, Rte. 1, Box 243, Smithville, Tex. 78957

[21] Appl. No.: 688,148

[22] Filed: May 20, 1976

[51] Int. Cl.[2] ..... B62D 33/00

[52] U.S. Cl. ..... 222/610; 222/166; 222/556; 296/51

[58] Field of Search ..... 222/44, 45, 48, 166, 222/176, 556, 566; 239/676, 657; 251/286, 297; 280/43.17, 727, 762, 769; 56/17.2; 214/508, 509; 292/19, 76, DIG. 17, DIG. 29; 296/50, 51

[56] References Cited

U.S. PATENT DOCUMENTS

| | | | |
|---|---|---|---|
| 2,344,755 | 3/1944 | Venard | 296/51 |
| 2,563,736 | 8/1951 | Newell | 296/51 |
| 2,818,270 | 12/1957 | Cataline | 280/43.17 |
| 2,885,122 | 5/1959 | Bruck | 222/556 X |
| 2,967,056 | 1/1961 | D'Amato | 222/166 X |
| 3,972,160 | 8/1976 | Boswell | 56/17.2 X |

*Primary Examiner*—Robert B. Reeves
*Assistant Examiner*—Fred A. Silverberg
*Attorney, Agent, or Firm*—Roylance, Abrams, Berdo & Kaul

[57] ABSTRACT

A dispenser which fits between the box of a dump truck and its partially open tailgate includes a semicylindrical trough having an axially elongated slot in the bottom, an arcuate relatively narrow cover adjacent to and outside of the trough, end plates on the trough, end hangers supporting the cover and pivotally mounted on axles in the end plates, and a handle on one of the end hangers to rotate the cover to open and close the slot. A notched detent bar on an end plate holds the handle in selected positions. Clamps hold the structure to the tailgate and latch bars cooperate with latch hooks on the truck to hold the dispenser in place. A cage hooks on the tailgate to support an operator. Interior hook eyes are provided to lift the dispenser into attachment position on the truck.

4 Claims, 10 Drawing Figures

GRANULAR MATERIAL DISTRIBUTOR

This invention relates to an apparatus for dispensing granular material and, particularly, to an apparatus for controllably distributing material such as gravel.

BACKGROUND OF THE INVENTION

It is common practice to use a truck having a tiltable body portion and a tailgate to dispense or distribute granular material such as salt, sand, gravel or the like over a surface. One such use arises in road maintenance, especially in warm climates, where the "blacktop" surfaced roads become soft in the heat of the sun and must be periodically coated with a new layer of rather fine gravel, sometimes known as pea gravel. Other familiar uses are in dispensing salt or sand, or a mixture thereof, onto ice or snow coated road surfaces in colder climates; and in spreading sand or gravel in road construction or secondary road resurfacing wherein no blacktop or other "hard" surface is provided. Still other uses will be apparent.

When a common tiltable "dump truck" is used, it is possible to open the tailgate, which is normally pivotally mounted at the top rear portion of the load-carrying body, and to then tilt the body to cause the granular material to simply run out of the back of the truck as the truck is slowly driven forward. In order to control the flow of material, the chain (or two chains) being connected to the tailgage and hooked to one or more latch plates on the side walls of the body, thereby holding the tailgate open only a small amount and limiting the flow of material through the slot between the bottom of the tailgate and the rear edge of the body floor. In this context, the term "body" refers to the tiltable "box" part of the truck rather than the main frame of the truck.

As will be readily recognized, this manner of flow control is, at best, somewhat crude and ineffective. The slot between the tailgate and floor can be set at intervals which are determined by the size of the chain links, and there is no guarantee that it will remain the same, as the tailgate oscillates during truck motion. Thus, the layer of material deposited by the truck is usually not uniform and results in waste of material and in the use of additional manpower behind the truck to evenly spread the material. Also, when stopping, the truck body must be lowered and the tailgate closed to stop the flow of material usually leaving a pile of material at the stop point.

Further, because of the relative crudeness and inaccuracy of the slot width adjustment, granular materials of various average granule sizes cannot be handled with equal efficiency.

Because of these problems, various attempts have been made to develop devices, some of which are shown in the following U.S. Pat. Nos.: 1,966,122; Hunt, 1,981,095; Dickerson, 2,005,896; Hunt, 2,557,704; Stevens, 3,072,290; de Biasi.

However, these devices are relatively complex and difficult to construct and require special machinery for their fabrication.

BRIEF SUMMARY OF THE INVENTION

Accordingly, it is an object of the present invention to provide a granular material dispenser or distributor which is simple to construct and use and which effectively controls the flow of granular material from the bed of a tiltable truck.

A further object is to provide a dispenser of the foregoing type which is easily controllable while the truck is in motion.

Another object is to provide such a dispenser which fits between the tiltable body portion and the tailgate of a truck, without modification of the truck, in conjunction with means to safely and conveniently support an operator, and which permits speedy and uniform distribution of granular material over a large area using a total crew of two persons.

Briefly described, the invention includes a material dispenser for selectivley dispensing granular material from a dump truck of the type having a tiltable body portion with an open end and a tailgate pivotable about an axis near the top of the open end, the dispenser comprising the combination of an elongated upwardly opening substantially semicylindrical trough having a central axis, means in the lower portion of the trough for defining a slot dimensioned to permit passage of granular material therethrough, an elongated arcuate cover plate having a length at least as great as the length of the slot and having a curvature substantially the same as the trough, hanger means for rotatably supporting the cover plate for concentric movement relative to and outside of the trough about an axis parallel with said central axis between a first position in which the cover plate lies immediately below and closes the slot and a second position in which the cover plate exposes the slot, lever means attached to the hanger means for manually moving the cover plate, and means for supporting the trough and the hanger means between the open end of the truck body portion and said tailgate with the tailgate in a partially opened position and with the upper portion of the trough at or below the level of the bed of the body portion.

In order that the manner in which the foregoing and other objects are attained in accordance with the invention can be understood in detail, a particularly advantageous embodiment thereof will be described with reference to the accompanying drawings, which form a part of this specification and wherein.

Figure 1:
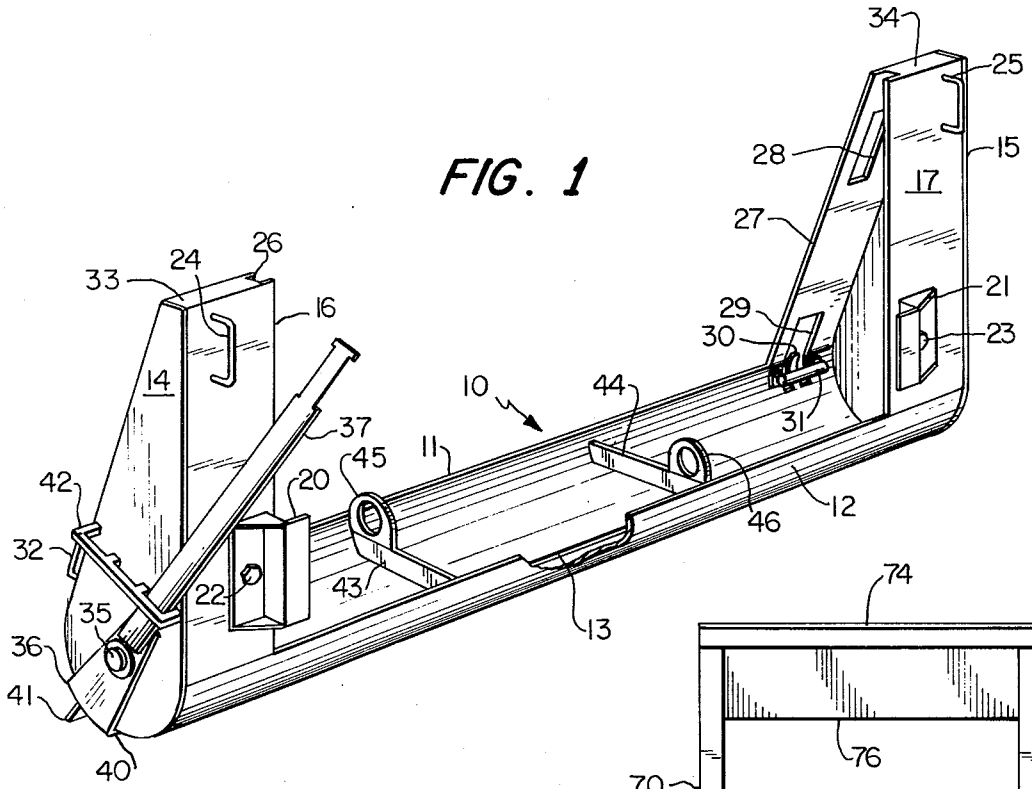
FIG. 1 is a perspective view of a dispenser according to the invention, apart from the truck with which it is used.

As shown in FIG. 1, the dispenser includes a semicylindrical trough indicated generally at 10 having arcuate portions 11 and 12 separated by a slot 13 which extends longitudinally along the bottom portion of the trough near the midportion thereof through which material to be dispensed can pass. Generally triangular end plates 14 and 15 having rounded lower portions to conform to the cylindrical shape of the trough are fixedly attached to the ends of the trough by welding. Back plates 16 and 17 are welded to the upwardly extending edges of plates 14 and 15, respectively, forming partial back closing plates for the dispenser. A rectangular U-shaped opening is thus defined between plates 16 and 17 and the upper edge of portion 12 of the trough. This opening will be closed, as will be described hereinafter, by the tailgate of a dump truck when the apparatus is installed thereon. Generally Z-shaped clamping members 20 and 21 are attached to plates 16 and 17, respectively, by bolts 22 and 23 which extend through holes in the clamping members and the plate and threadedly engage nuts, not visible in FIG. 1, which are welded to the inner surfaces of the plates. Thus, the clamping members can be loosened to permit insertion of the tailgate therebetween and can be tightened to fixedly attach the dispenser to the tailgate.

Convenience handles 24 and 25 are welded to the upper portions of plates 16 and 17 to facilitate handling and guiding of the apparatus during installation. Front plates 26 and 27 are welded to end pates 14 and 15, respectively, at those edges opposite the edges to which plates 16 and 17 are attached, the lower ends of all four plates being welded to the upper edges of the semicylindrical trough. As seen in FIG. 1, plate 27 is provided with a generally rectangular opening 28 and an opening 29, the upper portion of which is rectangular but the lower portion of which has a more complex configuration, these openings being for the purpose of receiving protruding elements on the truck itself. The lower portion of opening 29 has an upwardly extending finger 30 which lies approximately in the center of the opening. A latch bar 31 is welded to supporting posts and extends across the inside of opening 29 and is inwardly spaced from finger 30. Latch bar 31 is disposed in this location for the purpose of cooperating with a latch on the dump truck to retain the forward portion of the dispenser in proper position adjacent the truck body. Substantially identical openings are provided in plate 26, these not being visible in FIG. 1. Convenience handles, such as handle 32 on plate 26, are also provided. Small top plates 33 and 34 are welded into the opening remaining at the top of the front and back plates to maintain them in proper position.

Figure 4:
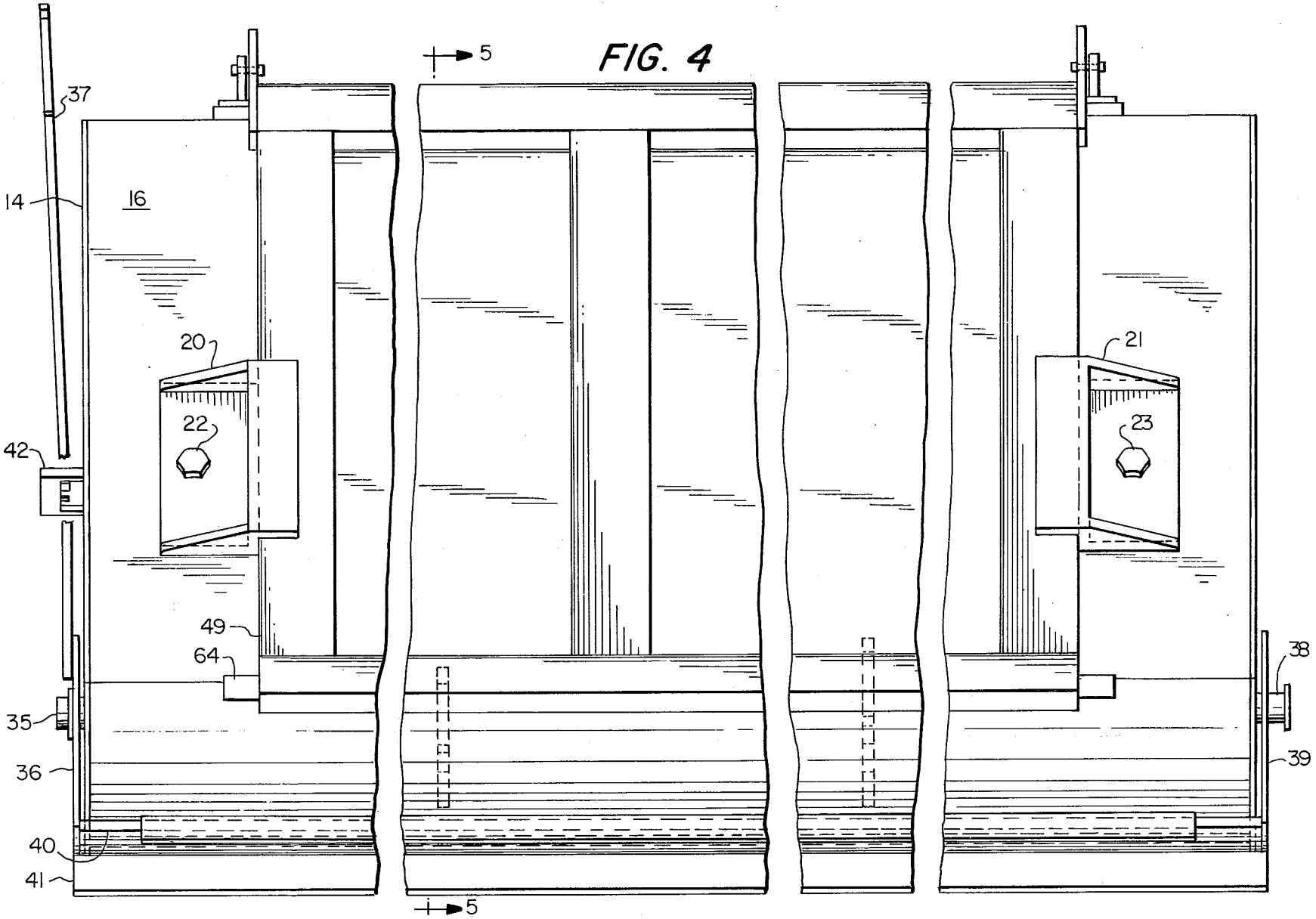
FIG. 4 is a foreshortened rear elevation of the truck and dispenser of FIGS. 2 and 3.

A short section of round bar stock is welded into and opening in, or onto the outer surface of plate 14 to form an axle 35, this axle being in approximate alignment with the central axis of trough 10. The distal end of axle 35 can have an enlarged head or can be threaded to receive a nut and washer. A hanger plate 36 which is in the shape of a truncated sector of a circle is provided with an opening so that it can freely rotate about axle 35. An elongated handle 37 is welded onto the outer surface of plate 36. At the opposite end of the structure, a similar axle 38 and hanger plate 39 are provided (FIG. 4). It will be observed that the lower extreme of plates 36 and 39 are curved on a circle which is on the same axis as axle 35. An arcuate cover plate 40, which has a width substantially equal to the widest portion of plates 36 and 39, and a length greater than the length of slot 13 is welded to the lower portion of each of these plates and extends there-between. A stiffening rib 41 is welded to the outer surface of cover 40 to provide rigidity for this relatively long member.

Handle 37 extends upwardly from plate 36 through a detent bar 42 which is welded to the outer surface of plate 14 and is provided with spaced notches to receive handle 37. As will be described, the handle is formed in such a way that it has a spring characteristic tending to urge it into the notches in bar 42. Thus, in order to move the handle, it is pressed inwardly toward plate 14, moved, and then released whereupon it can enter one of the notches. This will be described in greater detail hereinafter.

Within trough 10 are transverse flat bars 43 and 44 which are welded to the inner surfaces of portions 11 and 12 and which extend along chords of the circle in which the trough lies. These bars are axially spaced apart in a symmetrical fashion with respect to the transverse centerline of the trough. Hook plates 45 and 46 having central openings therein are welded to or integrally formed on opposite ends of bars 43 and 44, respectively, plate 45 being adjacent member 11 and plate 46 being adjacent member 12. Because of this oppositely disposed and symmetrical relationship, lifting forces applied to plates 45 and 46 can elevate dispenser in a level and symmetrical fashion.

Figure 3:
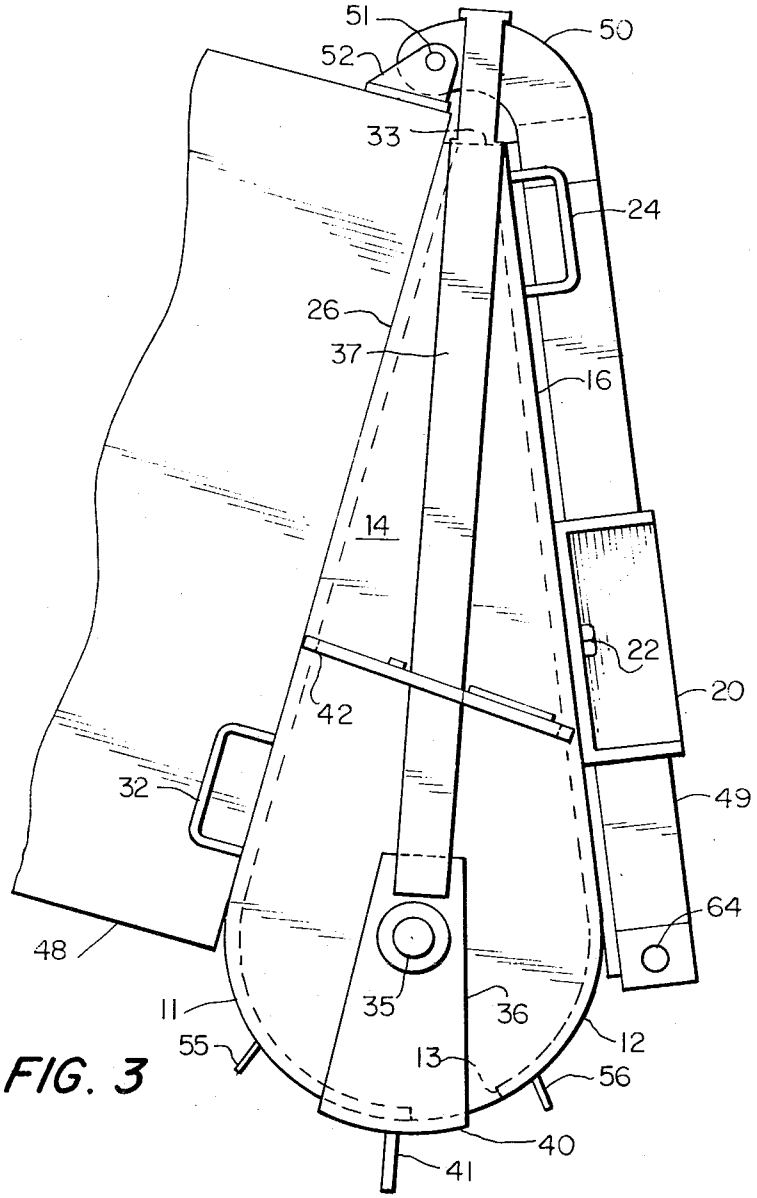
FIG. 3 is the dispenser of FIG. 2 showing the partially open dispensing position of the dispenser.
Figure 2:
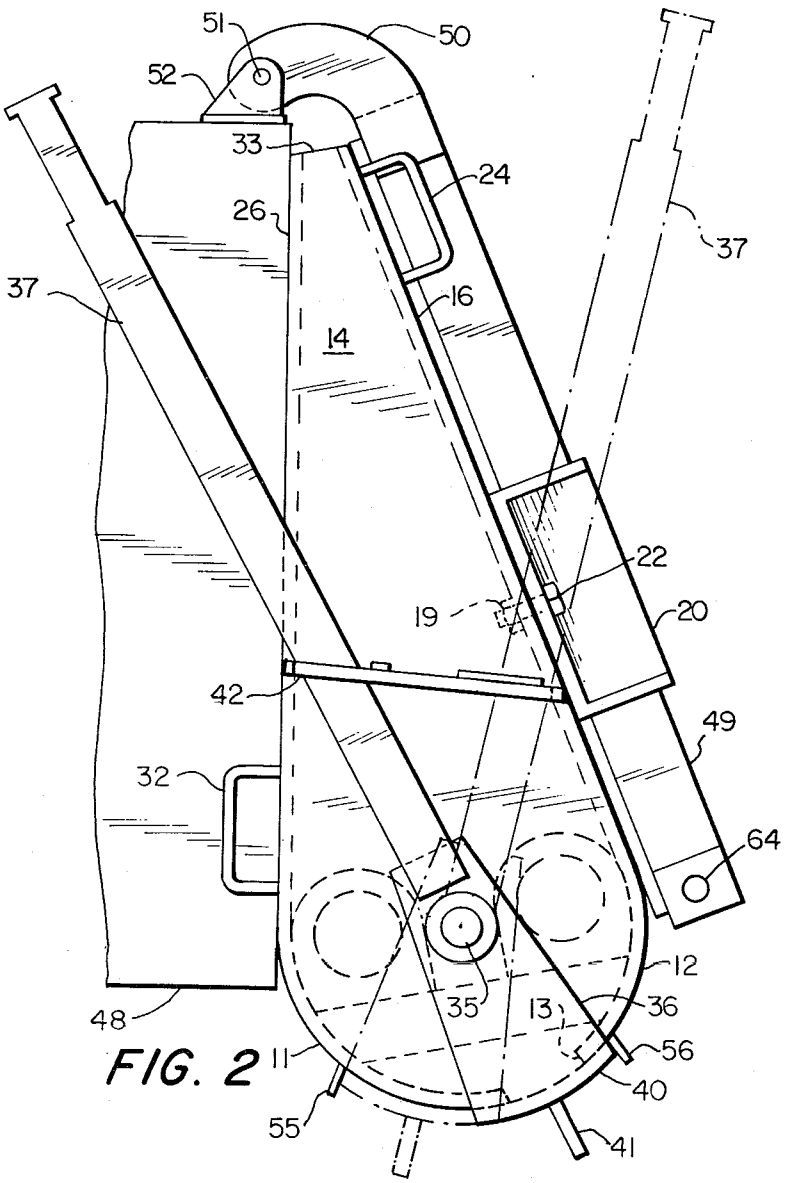
FIG. 2 is a side elevation of the dispenser of FIG. 1, mounted on a truck, showing the closed and fully open positions thereof.

Turning now to FIGS. 2–4, wherein the dispenser is shown mounted on a conventional dump truck, it will be seen that the identifying numerals employed in FIG. 1 are the same in these figures. The tiltable body portion of a dump truck is indicated at 48, this body portion being conventional in nature in that it has a floor or bed, upstanding substantially parallel side walls and an open end which is normally closable by a tailgate 49 having support members 50 at opposite ends thereof, the support members being pivotable about pins or axles 51 which pass through bracket members 52 attached to the upper portions of the side walls of body 48. As will be recognized, plates 26 and 27, along with the upper edge of arcuate portion 11, define a rectangular, generally U-shaped opening which is of substantially the same size as the open end of body portion 48, permitting flow of granular material, such as gravel, sand, salt or the like from the truck body into the dispenser. As seen in FIG. 4, the entire dispenser has a length in the axial direction of the trough which is substantially greater than the width of the truck body and tailgate, thereby permitting the ends of the dispenser to be free from interference with the truck and permitting clamping devices 20 and 21 to engage the lateral edges of the tailgate. Thus, the dispenser fits between the body and the partially open tailgate, as illustrated in FIGS. 2 and 3, and supports the trough portion in a position to receive material from the truck and to dispense it through slot 13.

Most of the components discussed with reference to FIG. 1 are visible in other views in FIGS. 2–4 and need not be repetitively described. FIG. 4 additionally shows axle 38 and hanger plate 39 and the connection of cover plate 40 between the two hanger plates. Also, FIG. 2 illustrates nut 19 which is welded to the interior of plate 16 to receive bolt 22.

The primary purpose of FIGS. 2 and 3 is to illustrate the various positions of handle 37, cover plate 40 and the hanger plates in their operative positions. In solid lines in FIG. 2, handle 37 is shown in the closed position with the truck body in a level condition. In this position, slot 13 is closed by cover plate 40 and no material can pass through the dispenser. In phantom lines in FIG. 2, handle 37 is shown in the complete opposite position with cover plate 40 moved completely away from slot 13, entirely opening the slot. Depending upon the size of the material to be dispensed, this can be an operative position. However, it is contemplated that the dimension of slot 13 is such that it is larger than the maximum size of particles of material to be dispensed. Thus, the position shown in phantom lines in FIG. 2 would be employed only for purposes of cleaning the dispenser after it has been used, the full opening being available to permit sweeping out over-sized particles and the like.

Normally, the dispenser would be operated in the position shown in FIG. 3 wherein handle 37 engages a central notch in detent bar 42 and cover plate 40 only partially covers slot 13, leaving a slot of relatively small size through which particles can be uniformly dispensed. As will be recognized, material can emerge along the entire length of slot 13 in the position shown in FIG. 3, the material being dumped into the dispenser continuously from the tilted body 48 of the truck. It will further be recognized that the handle can be moved between the closed and partially open position while the truck is moving, thereby preventing the occurrence of a large deposit of material as is the case when the tailgate adjustment alone is employed.

While detent bar 42 is normally sufficient to establish various positions of handle 37 and, thereby, the hanger plates and cover 40, positive stops 55 and 56 can be welded to the exterior surface of trough 10 to define the extreme limits of movement of the cover plate.

Figure 6:
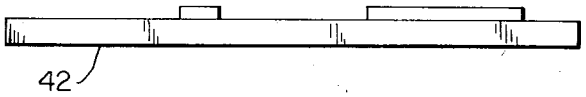
FIGS. 6 and 7 are detail side elevation and plan views, respectively, of the detent bar of the dispenser of FIGS. 1–5.
Figure 7:
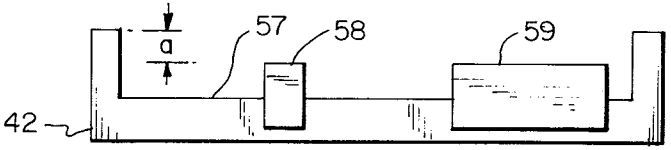

As shown in FIGS. 6 and 7, the detent bar can be simply produced from flat bar stock by cutting a notch 57 into one side of a bar of suitable length and welding flat rectangular members 58 and 59 to one surface thereof with portions of the members protruding into the U-shaped gap, the distal ends of these members being spaced from the ends of the end legs of the bar by a distance A which is greater than the thickness of handle 37. Then, the latch bar can be welded onto end plate 14 in a suitable position to cooperate with handle 37 in the desired positions.

The handle itself is attached in a way which permits it to have a spring action to cooperate with the detent bar as is illustrated in FIG. 4. Handle 37 is welded onto the upper portion of hanger plate 36 and, in the welding process, is heated and softened to a slight degree. While still hot, the upper end of handle 37 is pulled outwardly, preferably before attachment of latch bar 42, so that it is permitted to cool having a slight outward bend with respect to plate 14. Using conventional cold rolled flat stock, the bar then retains a spring characteristic which permits it to be pushed inwardly and move to one position from another past the projections on latch bar 42 so that, upon release, the handle tends to move outwardly and engage one of the notches in the latch bar.

Figure 5:
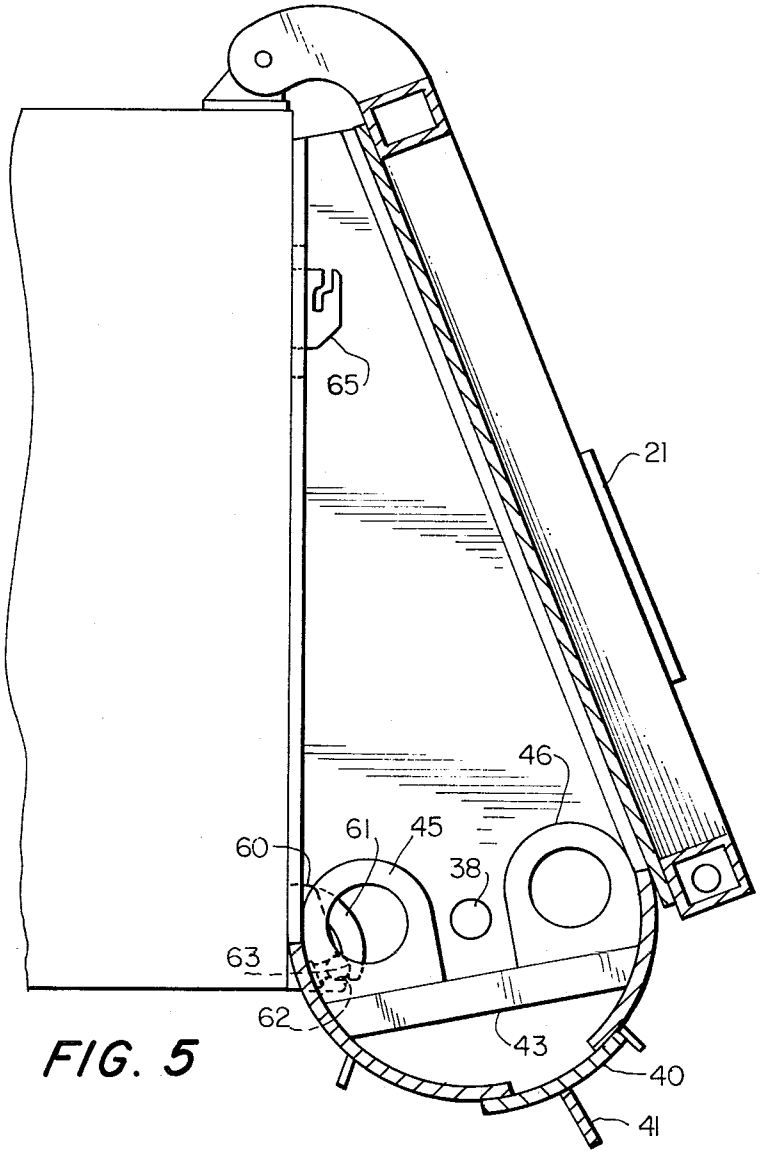
FIG. 5 is a side elevation, in partial section, of the apparatus of FIGS. 2–4.

FIG. 5 more clearly illustrates the interior lifting structure including the transverse bars and plates 45 and 46. When installing the dispenser on a truck, the dispenser is simply placed on the ground in a position similar to that shown in FIG. 1. A truck is backed up to the location of the dispenser and then the truck bed is raised to an angle of approximately 35 ° to 40° to allow the tailgate to swing open and to lower the back of the truck bed so that the distributor can be more easily attached. Cables attached to a separate lifting device, such as a conventional portable hoist or crane, are then passed downwardly through the opening at the top of the tailgate between the tailgate and the truck body and hooks on these cables, not shown, are passed through the opening in plates 45 and 46. The dispenser is then lifted and, when in proper position, clamps 20 and 21 are rotated to the position shown in FIGS. 1 and 4 and bolts 22 and 23 are tightened, thereby firmly clamping the dispenser onto the tailgate.

It is also desirable to attach the dispenser to the body of the truck at the forward portion thereof. Many trucks are conventionally provided with latch devices similar to that illustrated in FIG. 5 wherein there is a pair of rearwardly extending plates 60 and a movable pawl 61 between those plates. Plates 60 each have an arcuate recess 62 at the lower portion thereof and pawl member 61 similarly has a mating arcuate recess 63. The purpose of this arrangement is to permit the pawl and plate assembly to engage laterally extending rods 64 which are provided at the lower outer corners of the tailgate. When the tailgate is opened and the dispenser applied, plates 60 and pawl 61 can pass through opening 29 and the pawl can engage latch bar 31, as shown in FIG. 1, with finger 30 extending upwardly between the plates and behind the pawl to prevent inadvertent escape of granular material through that opening. Thus, the dispenser is fixedly attached to the truck body as well as to the tailgate. No other attachment is necessary.

Dump trucks of this general variety are also commonly supplied with plates 65 protruding from the rear portion thereof, these plates being to engage chains on the tailgate for limiting motion of the tailgate. Openings 28 are provided to permit these plates to pass through, although no functional use of the plates is made in the dispenser apparatus.

The dispenser thus described can be simply manufactured from tube, flat and bar stock using substantially no major tools other than welding equipment. A typical procedure for manufacture of the apparatus will now be described.

The manufacture of the apparatus is commenced by longitudinally cutting a pipe, such as 12 inches OD pipe having a wall thickness of about ¼ inches to 5/16 inches into two halves, the length of the pipe being, for example, about 8 feet. End plates 14 and 15 are then cut from flat stock and welded onto the ends of the pipe as shown in FIG. 1. The end plates are welded on first so that portions 11 and 12 need not be handled and aligned separately. The lifting plates including bars 43 and 44 and plates 45 and 46 are then cut and welded into the interior of the pipe and the flat plates for the front and rear walls are cut. The apparatus can then be lifted onto the truck in the operating position and the front and back walls can be placed in their proper positions, fitted to the specific truck, and tack welded in position. While this need not be done on the truck, this procedure provides a close fit to prevent escape of gravel from the final article. The tack-welded apparatus can then be lowered from the truck and the welding can be completed. The slot 13 is then cut into the pipe.

Bar stock is then cut to form the axle and welded onto the end plates. Holes can be cut in the end plates and the bar stock inserted therein and welded in place for additional strength. The hanger plates are then cut and applied over the axles and the cover plate is cut from the remaining half of the pipe from which the trough was produced and welded onto the hanger plates. The lever can then be cut from flat stock and welded onto hanger plate 36, as previously described. The latch bar is then cut and applied to end plate 14, the notch-forming tabs 58 and 59 being applied either before or after mounting of the latch bar. The remaining components can then be cut and applied, forming the clamp members 20 and 21 separately and the apertures, stiffening bars and stop can be cut and welded into position, fitting these on the truck as necessary.

Figure 10:
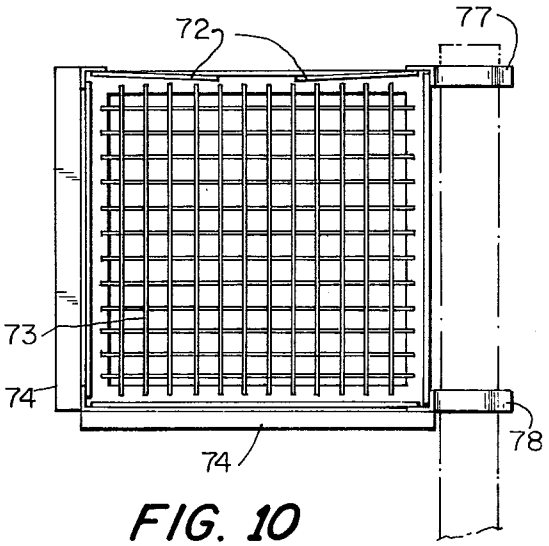
FIGS. 8, 9 and 10 are front elevation, side elevation and plan views, respectively, of an operator-supporting cage usable in conjunction with the dispenser of the present invention.
Figure 9:
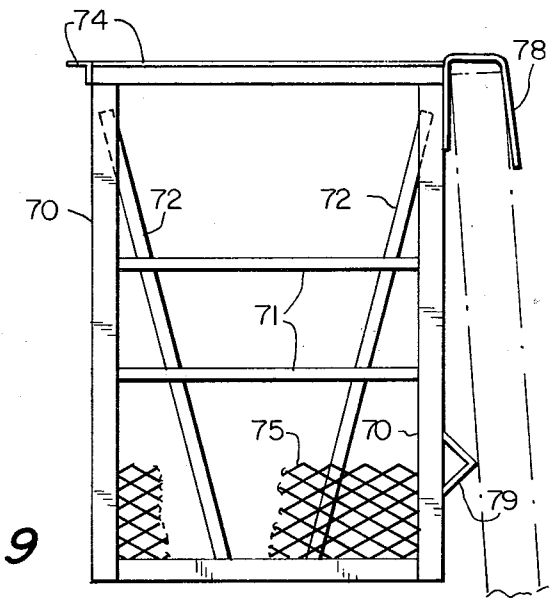
Figure 8:
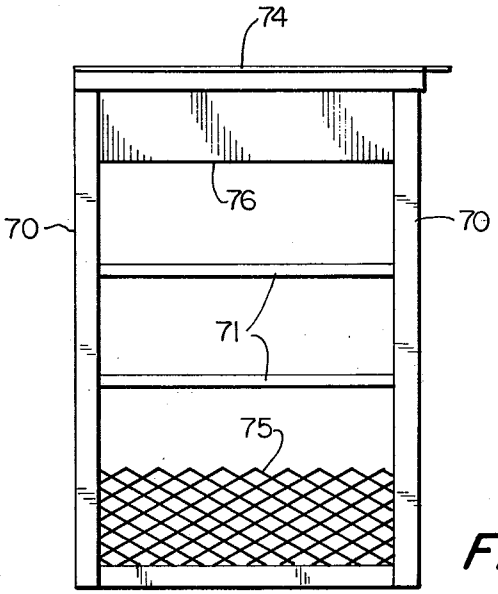

As previously indicated, one advantage of this dispenser is that it can be started and stopped while the truck is in motion and the rate of flow can also be controlled, by moving the bar to positions between notches, while in motion. To facilitate this operation, and to provide a safe and convenient location for an operator, there is provided an operator support cage which is shown in FIGS. 8, 9 and 10. As shown therein, the cage includes four angle corner members 70 with crosspieces 71 between members 70 around three sides and diagonal struts 72 forming the fourth side, left partially open for access, these being also welded together. A wire grid 73 is welded across the bottom opening of the cage to provide a surface on which the operator can stand and through which rain water can pass. Additional angle members 74 are welded around the top of the structure on the two sides which will face away from the truck and the open side having struts 72, for additional rigidity and to complete the enclosure. Screen 75 and protective plates such as at 76 can be employed to close the sides of the structure to prevent the possibility of portions of the operator slipping therethrough.

Finally, hook members 77 and 78 are formed from flat stock and welded onto that side of the cage which is to be next to the truck and spacer members 79 are attached to the cage near the lower portion thereof. As can be seen in FIG. 9 and 10, hooks 77 and 78 are designed to engage the top of the tailgate and spacers 79 hold the bottom portion of the cage away from the tailgate so that when the tiltable portion of the truck is tilted into a dispensing position, the cage remains substantially vertical. The operator is then in a convenient position near one side of the tailgate adjacent end plate 14 so that he can simply reach to and grasp handle 37 to operate the dispenser as required. At the same time, he is in a position to observe the flow of material into and out of the dispenser and make whatever adjustments are necessary during operation.

As previously indicated the total width of the dispenser slot 13 is 8 feet. There may be circumstances in which it is desirable to deposit a swath of gravel or other material narrower than this total width, in which case it has been found that a sheet of tar paper, cardboard, metal or other material can be placed inside the trough at one or both ends to block the interior end portions of slot 13, thus decreasing the effective length of the slot to any desired degree. Because cover plate 40 operates entirely outside of the trough, the material thus placed does not interfere in any way with the proper operation of the apparatus.

While one advantageous embodiment has been chosen to illustrate the invention, it will be understood by those skilled in the art that various changes and modifications can be made therein without departing from the scope of the invention as defined in the appended claims.

What is claimed is:

1. A material dispenser for selectively dispensing granular material from a dump truck of the type having a tiltable body portion with an open end and a tailgate pivotable about an axis near the top of said open end, said dispenser comprising the combination of an elongated upwardly opening, substantially semicylindrical trough having a central axis, said trough having a length greater than the width of said tiltable body portion;

means in the lower portion of said trough defining a longitudinally extending slot dimensioned for permitting passage of granular material of a predetermined average size therethrough;

an elongated arcuate cover plate having a length at least as great as the length of said slot and having a curvature substantially the same as said trough;

hanger means for rotatably supporting said cover plate for concentric movement relative to and outside of said trough about an axis parallel with said central axis between a first position in which said cover plate lies immediately below and closes said slot and a second position in which said cover plate exposes said slot, said hanger means including first and second end plates having a tapered configuration to conform to the opening between said body portion and said partially open tailgate, said end plates being fixedly attached to opposite ends of said trough and having arcuate lower edges conforming to the shape of said trough, first and second hanger plates attached to opposite ends of said cover plate and extending parallel with said end plates, and axle means for rotatably supporting said hanger plates on said end plates;

lever means attached to one of said hanger plates for manually moving said cover plate; and means for supporting said trough and said hanger means between the open end of said truck body portion and said tailgate with said tailgate in a partially opened position and with the upper portion of said trough at or below the level of the floor of said body portion, said means including first and second wall portions extending upwardly from said trough and inwardly from edges of said end plates toward and beyond the sides of said tailgate, and clamp means on each of said wall portions for engaging and gripping said sides of said tailgate.

2. A dispenser according to claim 1 and further comprising latch means mounted on one of said end plates for retaining said lever in a selected one of a plurality of positions corresponding at least to said first and second positions of said cover plate, said lever means being sufficiently resilient to permit release from said latch means for movement between said positions.

3. A dispenser according to claim 2 and further comprising stop means attached to the outer surface of said trough for limiting the movement of said cover plate at the extremes of said first and second position.

4. A dispenser according to claim 1 wherein said tiltable body portion is provided with latch members at the rear portion thereof and wherein said means for supporting includes wall means extending inwardly from edges of said end plates and from the front portion of said trough for forming, with said truck body portion, a granular material-containing volume; and means on said wall means for engaging said latch members.

* * * * *